US006030059A

United States Patent [19]

Stravitz

[11] Patent Number: 6,030,059

[45] Date of Patent: Feb. 29, 2000

[54] ORGANIZER WITH HORIZONTAL STORAGE SECTIONS AND AT LEAST ONE VERTICAL STORAGE SECTION HAVING AT LEAST ONE REMOVABLE SHELF

[76] Inventor: David M. Stravitz, 16 Park Ave., Suite 14A, New York, N.Y. 10016

[21] Appl. No.: 09/104,615

[22] Filed: Jun. 25, 1998

[51] Int. Cl.[7] ..... A47B 81/06

[52] U.S. Cl. ..... 312/9.47; 312/9.55; 312/351; 312/350; 211/153; 206/387.14

[58] Field of Search ..... 108/60, 62, 12, 108/13, 27; 312/9.5, 9.52, 9.53, 9.55, 9.47, 137, 119, 122, 126, 233, 8.8, 8.11, 350, 351, 348.3; 211/153, 42, 43, 40; 206/387.14, 387.1

[56] References Cited

U.S. PATENT DOCUMENTS

| | | | |
|---|---|---|---|
| 1,238,112 | 8/1917 | Deterling | 312/9.53 |
| 1,833,081 | 11/1931 | Kilmer | 312/351 |
| 4,531,645 | 7/1985 | Tisbo et al. | 312/126 |
| 4,735,469 | 4/1988 | Liggett | 312/233 |
| 5,383,722 | 1/1995 | Chen | 312/348.3 |

FOREIGN PATENT DOCUMENTS

| | | | |
|---|---|---|---|
| 185949 | 6/1956 | Germany | 211/42 |

*Primary Examiner*—Peter M. Cuomo
*Assistant Examiner*—Gerald A. Anderson
*Attorney, Agent, or Firm*—Frishauf, Holtz, Goodman, Langer & Chick, P.C.

[57] ABSTRACT

An organizer includes a plurality of horizontal compartments defined by horizontally arranged shelves, and at least one vertical compartment arranged adjacent to the plurality of horizontal compartments. A slide-out shelf is removably mounted at an intermediate position in a vertical direction of the at least one vertical compartment to divide the at least one vertical compartment into an upper compartment and a lower compartment. The slide-out shelf has a first said stop on a first surface thereof and a second said stop on an opposite second surface thereof for preventing excessive insertion of objects into one of the upper compartment and lower compartment of the at least one vertical compartment. In addition, the slide-out shelf is reversibly mountable at the intermediate position in the vertical direction of the at least one vertical compartment so as to present one of the first surface and the second surface as a lower surface of the upper compartment of the at least one vertical compartment. The first stop is positioned offset from the second stop in a lengthwise direction of the slide-out shelf so as to provide full depth storage in the upper compartment when the first surface is presented as the lower surface thereof, and so as to provide partial depth storage in the upper compartment when the second surface is presented as the lower surface thereof.

16 Claims, 3 Drawing Sheets

ORGANIZER WITH HORIZONTAL STORAGE SECTIONS AND AT LEAST ONE VERTICAL STORAGE SECTION HAVING AT LEAST ONE REMOVABLE SHELF

BACKGROUND OF THE INVENTION

The present invention relates to organizers with horizontal storage sections and vertical storage sections, and more particularly, is directed to a sorter or organizer which includes at least one vertical storage section having at least one removable shelf.

Plastic organizers for office and home use are well known. Such organizers are generally molded to have fixed compartments therein, with the compartments extending either in the horizontal direction only or the vertical direction only. In many instances, however, it is desirable to place some items with a horizontal orientation and other items in a vertical orientation. Conventionally, however, this requires the use of two different organizers.

The shelves in conventional organizers are generally of a fixed nature. Accordingly, if an item is too large to fit on the shelf of a conventional organizer, a different organizer must be used. In a like manner, if small items are desired to be stored, the small items may be too small for the shelves and may not fit properly therein or may fall down on the shelves. Further, with conventional fixed shelves, it is difficult to correctly orient the items on the shelves as well as to pull out the items from the shelves.

SUMMARY OF THE INVENTION

Accordingly, it is an object of the present invention to provide a sorter/organizer that overcomes the aforementioned problems.

It is another object of the present invention to provide a sorter/organizer having both horizontally arranged compartments and vertically arranged compartments.

It is still another object of the present invention to provide a sorter/organizer including at least one vertically arranged compartment having a slide-out shelf which converts the vertically arranged compartment from a single elongated compartment for storing tall items to at least two shortened compartments for storing smaller articles.

It is yet another object of the present invention to provide a sorter/organizer which can retain items stored on the slide-out shelves in a position in which they can be easily removed.

It is a further object of the present invention to provide a sorter/organizer in which the slide-out shelves can be used in two different orientations for holding different types of items thereon.

It is a still further object of the present invention to provide a sorter/organizer in which the slide-out shelves have stops at different locations to as to enable items to be correctly located thereon and so as to enable stored items to be easily removed from the shelves.

It is a yet further object of the present invention to provide a sorter/organizer that is easy and economical to make and use.

According to the present invention, a sorter/organizer comprises a plurality of horizontal compartments defined by horizontally arranged shelves, and at least one vertical compartment arranged adjacent the plurality of horizontal compartments. A slide-out shelf is removably mounted at an intermediate position in the vertical direction of the at least one vertically arranged compartment. The slide-out shelf preferably has a stop thereon for preventing excessive insertion of short objects into the at least one vertical compartment, and the slide-out shelf is preferably reversible to provide either full depth storage in one position or partial depth storage in a turned over position.

More specifically, in accordance with a first aspect of the present invention, an organizer includes a plurality of horizontal compartments defined by horizontally arranged shelves, and at least one vertical compartment arranged adjacent to the plurality of horizontal compartments. A slide-out shelf is removably mounted at an intermediate position in a vertical direction of the at least one vertical compartment to divide the at least one vertical compartment into an upper compartment and a lower compartment. The slide-out shelf has a first said stop on a first surface thereof and a second said stop on an opposite second surface thereof for preventing excessive insertion of objects into one of the upper compartment and lower compartment of the at least one vertical compartment. In addition, the slide-out shelf is reversibly mountable at the intermediate position in the vertical direction of the at least one vertical compartment so as to present one of the first surface and the second surface as a lower surface of the upper compartment of the at least one vertical compartment. The first stop is positioned offset from the second stop in a lengthwise direction of the slide-out shelf so as to provide full depth storage in the upper compartment when the first surface is presented as the lower surface thereof, and so as to provide partial depth storage in the upper compartment when the second surface is presented as the lower surface thereof.

In one embodiment, the second stop is angled relative to the lengthwise direction of the slide-out shelf, and the first stop is substantially perpendicular to the lengthwise direction of the slide-out shelf. In another embodiment, the first and second stops are both substantially perpendicular to the lengthwise direction of the slide-out shelf. Also, each vertical compartment may be open at a front portion of the organizer, and a rear wall may be provided to close a rear portion of said organizer. Still further, the rear wall may include at least one access opening to permit access to the at least one vertical compartment so as to enable a user to push stored items out of the vertical compartment.

Preferably, there are two vertical compartments, one on each side of the plurality of horizontal compartments, and in addition, at least one of the horizontally arranged shelves may include a cut-out at a front portion thereof for enabling a user to easily remove an item stored in one of the plurality of horizontal compartments.

In accordance with another aspect of the present invention, an organizer includes a plurality of horizontal compartments defined by horizontally arranged shelves, and two vertical compartments respectively arranged adjacent to the plurality of horizontal compartments on opposite sides thereof. At least one slide-out shelf is provided which is removably mountable at an intermediate position in a vertical direction of each of the two vertical compartments so as to divide a given one of the two vertical compartments in which the slide-shelf is mounted into an upper compartment and a lower compartment. The slide-out shelf has a first stop on a first surface thereof and a second stop on an opposite second surface thereof for preventing excessive insertion of objects into one of the upper compartment and lower compartment of the given one of the two vertical compartments in which the slide-shelf is mounted. In addition, the slide-out shelf is reversibly mountable at the intermediate position in the vertical direction of each of the two vertical compartments so as to present one of the first surface and the second surface as a lower surface of the upper compartment of the given one of the two vertical compartments in which the slide-shelf is mounted.

The above and other objects, features and advantages of the present invention will become readily apparent from the following detailed description thereof which is to be read in connection with the accompanying drawings.

DETAILED DESCRIPTION

Figure 1:
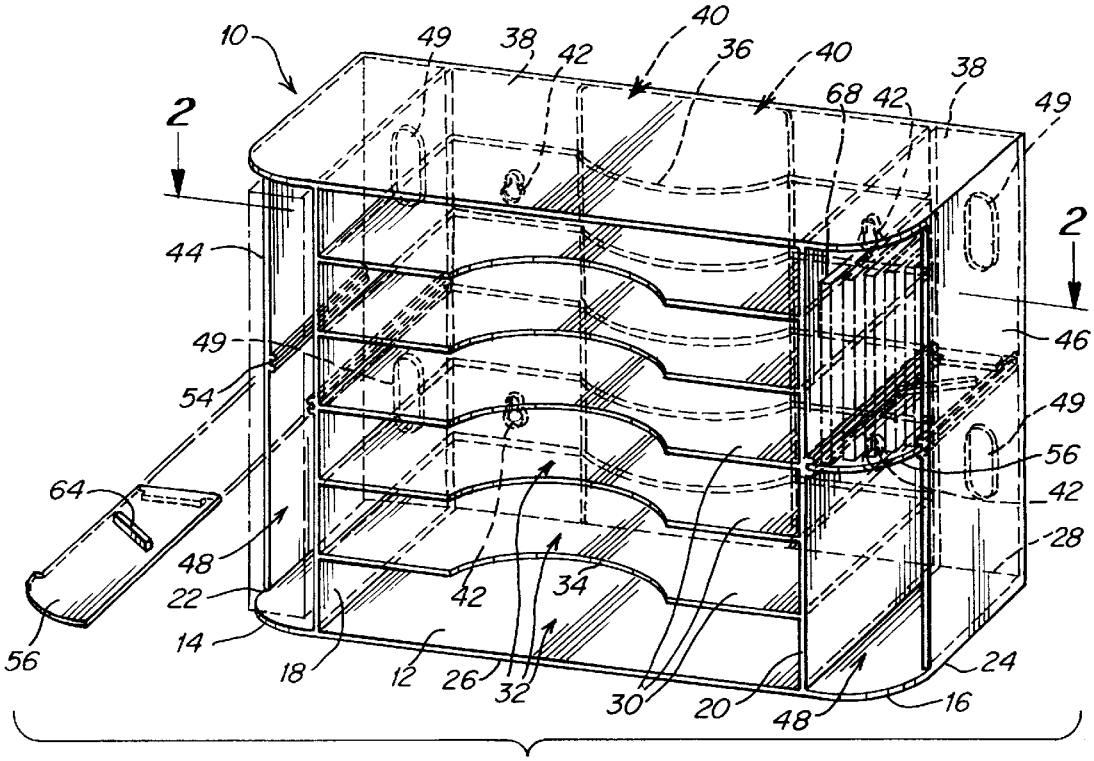
FIG. 1 is a perspective view of a sorter/organizer according to the present invention, showing one slide-out shelf in a fully inserted position, and one slide-out second shelf in a removed position.

Referring to the drawings in detail, and initially to FIGS. 1–5 thereof, a sorter/organizer 10 according to a first embodiment of the present invention includes a horizontal base wall 12 which supports sorter/organizer 10 on a surface such as a desk or the like. Base wall 12 has a generally rectangular configuration, with rounded outer front corners 14 and 16. Base wall 12, as well as all other components of the sorter/organizer 10, are preferably molded from a durable, plastic material. However, the present invention is not limited to such a plastic material.

The sorter/organizer 10 includes two upstanding rectangular vertical walls 18 and 20 spaced inwardly from side edges 22 and 24 of base wall 12, with vertical walls 18 and 20 being substantially parallel to each other and to side edges 22 and 24 and extending substantially the full length between front edge 26 and rear edge 28 of base wall 12.

A plurality of fixed horizontal shelves 30 are connected between vertical walls 18 and 20 in a spaced, vertical relation to define a plurality of horizontally extending compartments 32, which are open at the front portion of the sorter/organizer 10 so as to enable items which are stored in compartments 32, such as file folders 31, magazines, or the like, to be easily accessed. In order to allow for easy access of file folders 31, for example, the front edges of horizontal shelves 30 have arcuate cut-outs 34 therein so as to enable easy grasping of the file folders 31 by a user.

Figure 2:
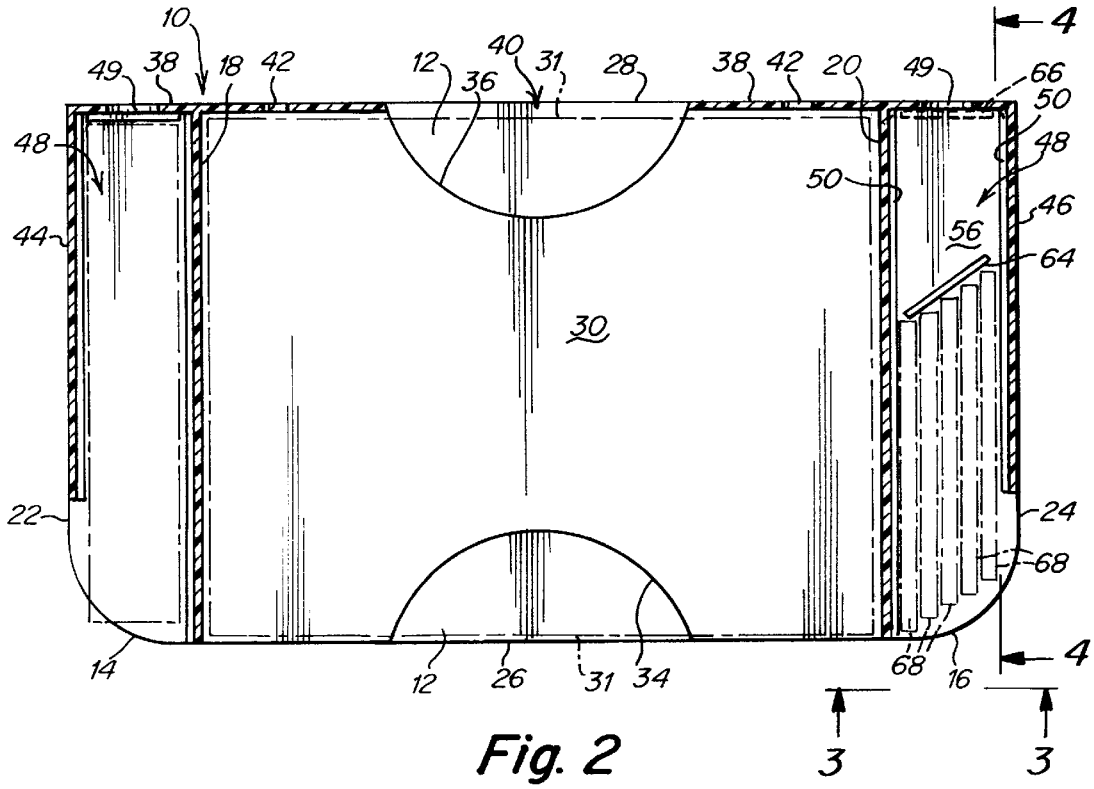
FIG. 2 is a cross-sectional view, taken along line 2—2 in FIG. 1, with only the right slide-out shelf in a fully inserted position.
Figure 3:
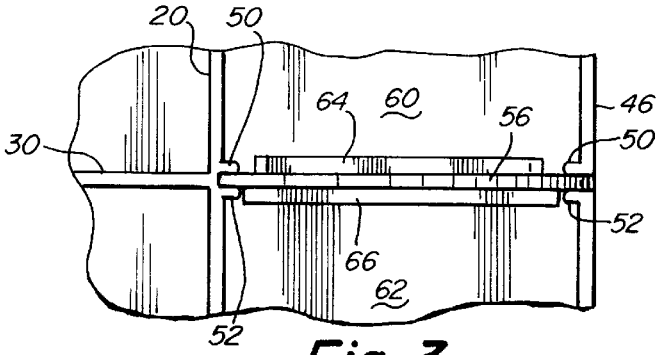
FIG. 3 is a fragmentary, front elevational view, as viewed along line 3—3 in FIG. 2.
Figure 4:
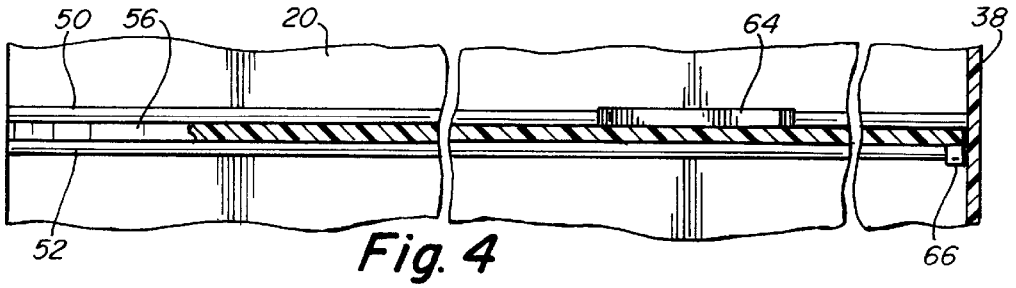
FIG. 4 is an enlarged, fragmentary, cross-sectional view, taken along line 4—4 in FIG. 2.
Figure 5:
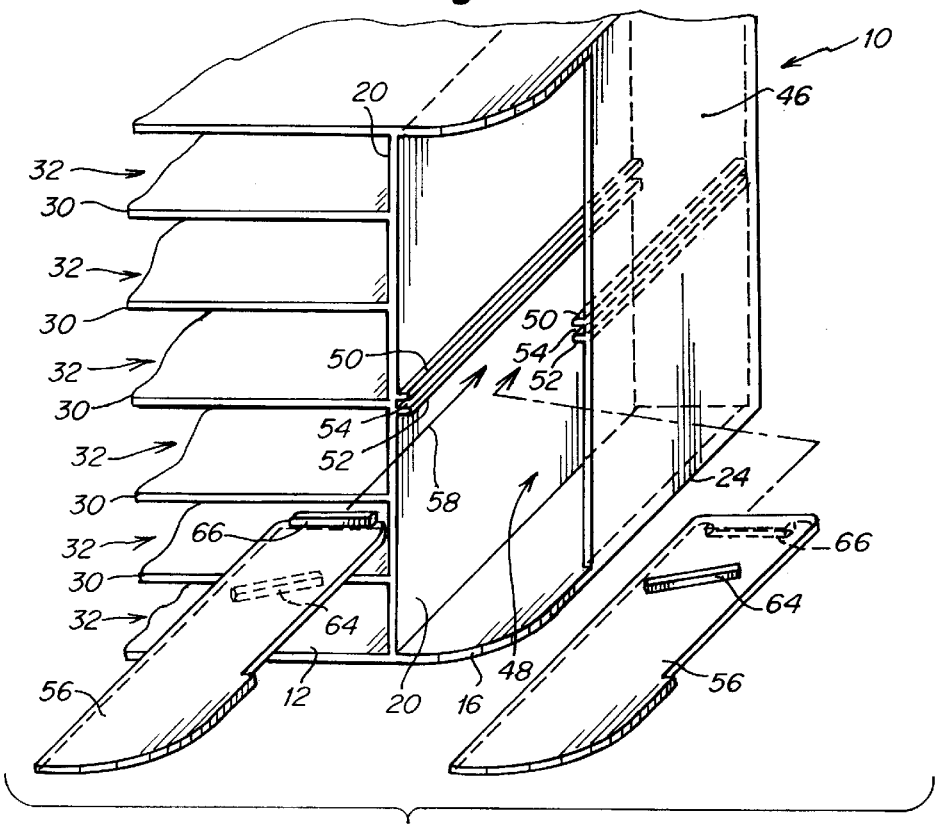
FIG. 5 is a fragmentary, exploded, perspective view showing an alternate arrangement of the slide-out shelves of FIGS. 1–4.

The rear edges of horizontal shelves 30 also preferably have arcuate cut-outs 36 therein for enabling a user to push the stored items out the front of the sorter/organizer 10 from behind. In this regard, a rear wall 38 is provided for closing a rear portion of each compartment 32. The rear wall 38 has a vertically extending opening 40 along a center portion thereof, with opening 40 having a width equal to the width of cut-outs 36 in order to permit access to cut-outs 36, as best shown in FIGS. 1 and 2. The rear wall 38 also closes the rear portion of each vertical compartment 48, and four oval access openings 49 are provided in the rear wall 38 at positions between vertical walls 20 and 46 and between vertical walls 18 and 44. As a result, as best shown in FIG. 1, easy access is permitted to the upper and lower portions of each vertical compartment 48 so as to enable items stored therein to be pushed out.

In addition, four keyhole hanger holes 42 are provided in rear wall 38, at a position between vertical walls 18 and 20, for hanging the sorter/organizer 10 on a wall.

Still further, the sorter/organizer 10 includes two upstanding outer rectangular vertical walls 44 and 46 at side edges 22 and 24 of base wall 12, with vertical walls 18 and 20 being substantially parallel to each other and to side edges 22 and 24, and extending from rear edge 28 of base wall 12 to a position short of front edge 26 of base wall 12 (e.g. to the start of front corners 14 and 16). Preferably, vertical walls 44 and 46 extend for the same height as vertical walls 18 and 20. As a result, elongated vertical compartments 48 are formed between vertical walls 18 and 44 and between vertical walls 20 and 46, which extend the entire height of the vertical walls.

As shown best in FIGS. 1 and 3–5, two substantially parallel, spaced apart ribs 50 and 52 extend in the horizontal direction from the rear edge to the front edge of each vertical wall 18, 20, 44 and 46, approximately mid-way along the height of the inner surfaces of the vertical walls, thereby defining a horizontal groove 54 between ribs 50 and 52. The horizontal grooves 54 of vertical walls 18, 20, 44 and 46 are substantially in line with each other.

The sorter/organizer 10 further includes horizontal slide-out shelves 56 for sliding in and out of facing grooves 54. Each slide-out shelf 56 has a shape similar to that portion of base wall 12 extending between rear wall 38 and vertical walls 18, 44 and 20, 46, with a rounded outer front edge corresponding to rounded outer corners 14 and 16. When a slide-out shelf 56 is inserted in the direction of arrow 58 in FIG. 5 to the position shown in the right side of FIGS. 1–4, the slide-out shelf 56 bisects the respective vertical compartment 48 into an upper compartment 60 and a lower compartment 62. Smaller items, such as compact discs 68 or the like, can then be stored in upper compartment 60 and the lower compartment 62.

It will be appreciated that the slide-out shelf 56 which fits into grooves 54 on the left side of the sorter/organizer 10 can also be fitted into the grooves 54 on the right side of the sorter/organizer 10 when turned upside down in a manner so that the shape of the slide-out shelf 56 matches the respective corners 14 and 16. Similarly, the slide-out shelf 56 which fits into the grooves 54 on the right side of the sorter/organizer 10 can also be fitted into the grooves 54 on the left side of the sorter/organizer 10 when turned upside down in a manner so that the shape of the slide-out shelf 56 matches the respective corners 14 and 16.

A raised, angled back stop 64 is positioned near the rear of each shelf 56 on one surface thereof, while a raised, transverse back stop 66 is positioned near the rear of each shelf 56 on the opposite surface thereof. Both back stops 64 and 66 function to limit the extent that items may be placed on the shelves 56 to prevent the items from falling backwards. In addition, the back stops 64 and 66 also help to enable correct positioning of the items on the shelves 56, and enable stored items to be easily removed when the shelves 56 are pulled or slid out. At the same time, back stops 64 and 66 function as stiffening ribs to strengthen shelves 56. And still further, the back stop 64, when oriented downward, may function to limit the extent that an item may be inserted into the lower compartment 62.

The angled back stop 64 is inclined to stagger compact discs 68 stored in the upper compartment 60 for easy retrieval of each compact disc 68 without requiring shelves 56 to be pulled out of the grooves 54. In this regard, the angled back stop 64 is provided at a position toward the rear wall of each shelf 56 so that the front edges of compact discs 68 are positioned near the front of the sorter/organizer 10.

It will be appreciated that since the slide-out shelves 56 may be reversibly fitted into the grooves 54 on the left and right sides of the sorter/organizer 10, the back stops 64 and 66 may be interchangeably presented so as to provide either full depth storage in the upper compartment 60 when the back stop 66 is presented on the lower surface of the upper compartment 60, or partial depth storage 64 in the turned over position when the back stop 66 is presented on the lower surface of the upper compartment 60.

In addition, it will be further appreciated that the rear corners of the shelves 56 are slightly rounded to permit easy insertion of the shelves 56 into the grooves 54.

It will therefore be appreciated that according to the present invention, the slide-out shelves 56 are slidable in and out of vertical compartments 48 to provide either a single elongated vertical compartment 48 when one of the shelves 56 is not mounted therein, or two smaller vertical compartments 60 and 62 when one of the shelves 56 is mounted therein. In addition, since each shelf 56 is reversible for use on either side of sorter/organizer 10, and since differently positioned back stops 64 and 66 are provided on opposite sides of each shelf 56, an extremely flexible sorter/organizer 10 is achieved which is adaptable to hold different sizes and types of items.

Figure 6:
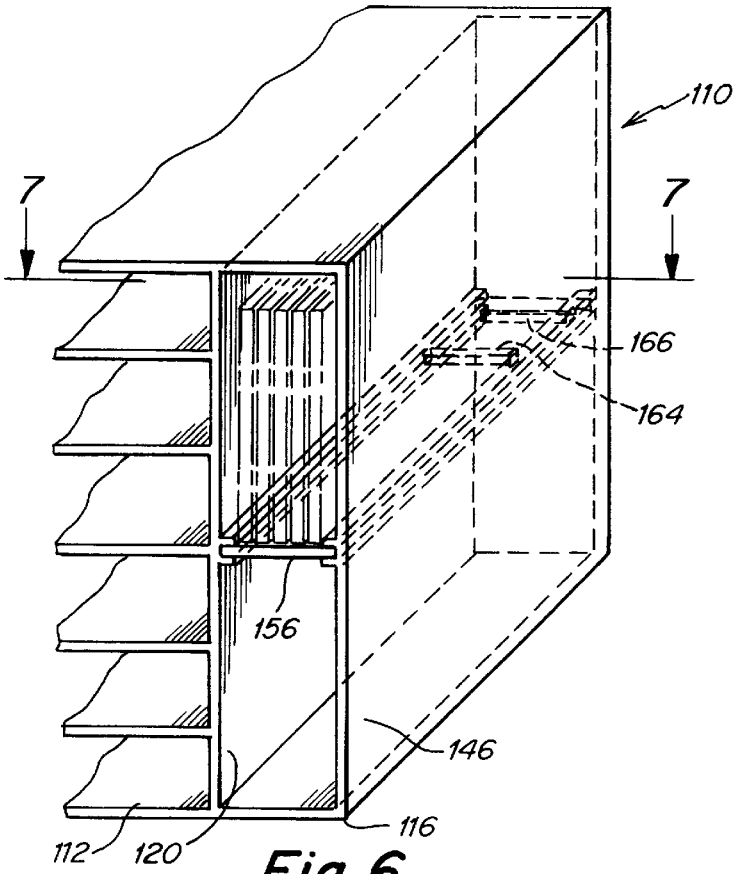
FIG. 6 is a perspective view of a portion of a sorter/organizer according to another embodiment of the present invention, having squared off ends and showing one slide-out shelf in a fully inserted position.
Figure 7:
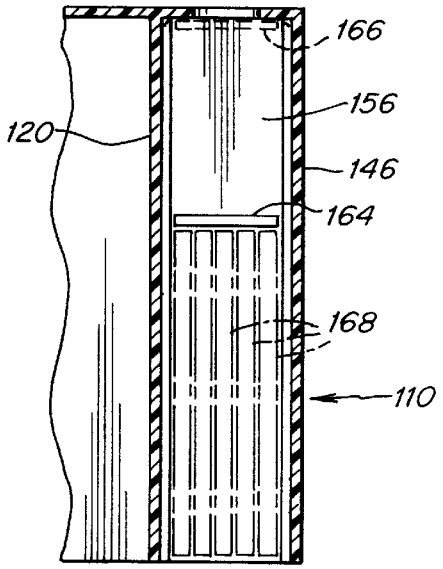
FIG. 7 is a cross-sectional view, taken along line 7—7 in FIG. 6.

Referring now to FIGS. 6 and 7, a sorter/organizer 110 according to another embodiment of the present invention will now be described with common elements being referred to by the same reference numerals, augmented by 100, as in the embodiment of FIGS. 1–5.

Sorter/organizer 110 differs from sorter/organizer 10 in two ways. First, the sorter/organizer 110 does not include rounded corners on base wall 112. Instead, sharp corners, such as corner 116, extend to the front of sorter/organizer 110. As such, the corresponding corners of the shelves 156 are similarly shaped and also extend to the front of the sorter/organizer 10. In addition, an upstanding rectangular vertical wall 146 extends for the same length as upstanding rectangular vertical wall 120.

Second, back stop 164 is transverse and parallel to back stop 166, and is positioned forwardly of back stop 166. As a result, compact discs 168 which are stored on the shelf 156 will not be staggered. Instead, the compact discs 168 will be aligned with each other at the front of the sorter/organizer 110. Accordingly, the shelf 156 is may be partially withdrawn from the sorter/organizer 110 to facilitate removal of a compact disc 168.

Having described specific preferred embodiments of the invention with reference to the accompanying drawings, it will be appreciated that the present invention is not limited to the precise embodiments described above, and that various changes and modifications can be effected by one of ordinary skill in the art without departing from the scope or spirit of the invention as defined by the appended claims.

What is claimed is:

1. An organizer comprising:

a plurality of horizontally extending compartments arranged one above another, the horizontal compartments being defined by opposite substantially vertical side walls and substantially horizontally arranged shelves arranged between said side walls and which are substantially parallel with each other and with a substantially horizontal base member, said side walls extending upwardly from said base member;

at least one vertical compartment arranged adjacent to the plurality of horizontal compartments and defined by opposite substantially vertical side walls, wherein one side wall that defines each vertical compartment is a common side wall that defines said horizontal compartments, and each vertical compartment extending in a vertical direction substantially at right angles to said horizontally arranged shelves and extending vertically over a distance corresponding to a plurality of the horizontal compartments; and a horizontal slide-out shelf removably mounted at an intermediate position of said at least one vertical compartment to divide said at least one vertical compartment into two compartments; and wherein:

said slide-out shelf has a first stop on a first surface thereof and a second stop on an opposite second surface thereof, said stops preventing excessive insertion of objects into said at least one vertical compartment, said first stop is substantially perpendicular to the lengthwise direction of said slide-out shelf, and said second stop is angled relative to the lengthwise direction of said slide-out shelf.

2. An organizer according to claim 1, wherein said at least one vertical compartment comprises two vertical compartments which are respectively provided on opposite sides of said plurality of horizontal compartments.

3. An organizer according to claim 1, wherein said slide-out shelf is reversibly mountable at the intermediate position of said at least one vertical compartment so as to present one of said first surface and said second surface as the upper surface of said slide-out shelf.

4. An organizer according to claim 3, wherein one of said first and second stops is positioned offset from the other of said first and second stops in a lengthwise direction of said slide-out shelf so as to provide full depth storage when said first surface is presented as the lower surface of the slide-out shelf, and so as to provide partial depth storage when said second surface is presented as the lower surface of the slide-out shelf.

5. An organizer according to claim 1, wherein at least one of said horizontally arranged shelves includes a front portion with a cut-out for enabling a user to easily remove an item stored in one of said plurality of horizontal compartments.

6. An organizer according to claim 1, further comprising a rear wall which closes a rear portion of said organizer, said rear wall including at least one access opening to permit access to said at least one vertical compartment so as to enable a user to push stored items out of the vertical compartment.

7. An organizer according to claim 1, further comprising:

a rear wall which closes a rear portion of said organizer; and wherein the other of said substantially vertical side walls that defines each vertical compartment extends in a forward direction from said rear wall to a lesser degree than said common side wall.

8. An organizer according to claim 7, wherein said second stop is angled rearwardly from the end thereof closest to said common side wall to the end thereof closest to said other substantially vertical side wall.

9. An organizer comprising:

a plurality of horizontally extending compartments arranged one above another, the horizontal compartments being defined by opposite substantially vertical side walls and substantially horizontally arranged shelves arranged between said side walls and which are substantially parallel with each other and with a substantially horizontal base member, said side walls extending upwardly from said base member;

two vertical compartments respectively arranged adjacent to the plurality of horizontal compartments on opposite sides of the horizontal compartments and each vertical compartment defined by opposite substantially vertical side walls, wherein one side wall that defines each vertical compartment is a common side wall that defines said horizontal compartments, and each vertical compartment extending in a vertical direction substantially at right angles to said horizontally arranged shelves and extending vertically over a distance corresponding to a plurality of the horizontal compartments; and at least one horizontal slide-out shelf which is removably mountable at an intermediate position of each of said two vertical compartments so as to divide a given one of said two vertical compartments in which said slide-out shelf is mounted into two compartments, said slide-out shelf having a first surface with a first stop on the first surface and an opposite second surface with a second stop on the opposite second surface for preventing excessive insertion of objects into one of the compartments of the given one of said two vertical compartments in which said slide-out shelf is mounted, and said slide-out shelf being reversibly mountable at the intermediate position of each of said two vertical compartments so as to present one of said first surface and said second surface as an upper compartment of said slide-out shelf; and wherein said second stop is angled relative to a lengthwise direction of said slide-out shelf, and said first stop is substantially perpendicular to the lengthwise direction of said slide-out shelf.

10. An organizer according to claim 9, further comprising a rear wall which closes a rear portion of said organizer, said rear wall including at least one access opening to permit access to at least one of said two vertical compartments so as to enable a user to push stored items out of said at least one of said two vertical compartments.

11. An organizer according to claim 9, wherein said at least one slide-out shelf comprises two slide-out shelves which are each removably mountable at the intermediate position of each of said two vertical compartments.

12. An organizer according to claim 9, wherein at least one of said horizontally arranged shelves includes a front portion with a cut-out for enabling a user to easily remove an item stored in one of said plurality of horizontal compartments.

13. An organizer according to claim 9, further comprising:

a rear wall which closes a rear portion of said organizer; and wherein the other of said substantially vertical side walls that defines each vertical compartment extends in a forward direction from said rear wall to a lesser degree than said common side wall.

14. An organizer according to claim 13, wherein said second stop is angled rearwardly from the end thereof closest to said common side wall to the end thereof closest to said other substantially vertical side wall.

15. An organizer according to claim 9, wherein said first stop is positioned offset from said second stop in a lengthwise direction of said slide-out shelf so as to provide full depth storage in the upper compartment of the given one of said two vertical compartments in which said slide-out shelf is mounted when said first surface is presented as the lower surface of the slide-out shelf, and so as to provide partial depth storage in the upper compartment of the given one of said two vertical compartments in which said slide-out shelf is mounted when said second surface is presented as the lower surface of the slide-out shelf.

16. An organizer according to claim 9, wherein said first and second stops are both substantially perpendicular to a lengthwise direction of said slide-out shelf.

* * * * *